US011353244B2

(12) United States Patent
Zha

(10) Patent No.: US 11,353,244 B2
(45) Date of Patent: Jun. 7, 2022

(54) COOLING SYSTEM WITH FLEXIBLE EVAPORATING TEMPERATURE

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 35 days.

(21) Appl. No.: 16/939,262

(22) Filed: Jul. 27, 2020

(65) Prior Publication Data

US 2022/0026115 A1 Jan. 27, 2022

(51) Int. Cl.

| | |
|---|---|
| ***F25B 1/10*** | (2006.01) |
| ***F25B 41/20*** | (2021.01) |
| ***F25B 41/40*** | (2021.01) |

(52) U.S. Cl.

CPC ..... *F25B 1/10* (2013.01); *F25B 41/20* (2021.01); *F25B 41/40* (2021.01); *F25B 2400/051* (2013.01); *F25B 2400/053* (2013.01); *F25B 2400/23* (2013.01)

(58) Field of Classification Search

CPC .. F25B 1/10; F25B 41/20; F25B 41/40; F25B 2400/051; F25B 2400/053; F25B 2400/23

See application file for complete search history.

(56) References Cited

U.S. PATENT DOCUMENTS

| | | | | |
|---|---|---|---|---|
| 7,207,186 | B2 * | 4/2007 | Hirota | F04F 5/04 62/228.3 |
| 9,759,462 | B2 * | 9/2017 | Zou | F25B 41/00 |
| 2013/0111934 | A1 * | 5/2013 | Wang | F25B 41/00 62/115 |

FOREIGN PATENT DOCUMENTS

| | | | |
|---|---|---|---|
| EP | 3647686 | A1 | 5/2020 |
| EP | 3671063 | A1 | 6/2020 |
| WO | 2018177956 | A1 | 10/2018 |

OTHER PUBLICATIONS

European Patent Office, Extended European Search Report, Application No. 21186716.3, dated Apr. 8, 2022, 10 pages.

* cited by examiner

*Primary Examiner* — Emmanuel E Duke
(74) *Attorney, Agent, or Firm* — Baker Botts L.L.P.

(57) ABSTRACT

A cooling system implements various processes to improve efficiency in high ambient temperatures. First, the system can flood one or more low side heat exchangers in the system. Second, the system can direct a portion of vapor refrigerant from a low side heat exchanger to a flash tank rather than to a compressor. Third, the system can transfer heat from refrigerant at a compressor suction to refrigerant at the discharge of a high side heat exchanger.

20 Claims, 3 Drawing Sheets

COOLING SYSTEM WITH FLEXIBLE EVAPORATING TEMPERATURE

TECHNICAL FIELD

This disclosure relates generally to a cooling system (e.g., a refrigeration system and/or an air conditioning system).

BACKGROUND

Cooling systems may cycle a refrigerant to cool various spaces. For example, a system may cycle refrigerant to cool spaces near or around low side heat exchangers.

SUMMARY

Cooling systems (e.g., refrigeration systems and/or air conditioning systems) may cycle a refrigerant to cool various spaces. For example, a system may cycle refrigerant to cool spaces near or around low side heat exchangers. One refrigerant that has seen increasing use in cooling systems is carbon dioxide, due to its environmentally friendly properties relative to other conventional refrigerants. One drawback of carbon dioxide refrigerant, however, is that carbon dioxide refrigerant is difficult to use and manage in extreme temperatures. For example, cooling systems that use carbon dioxide refrigerant tend to operate more inefficiently in high ambient heat than cooling systems that use other refrigerants. It may be more difficult to regulate the pressure of the carbon dioxide refrigerant and to remove heat from the carbon dioxide refrigerant in high ambient heat.

This disclosure contemplates a cooling system that implements various processes to improve efficiency in high ambient temperatures. First, the system can flood one or more low side heat exchangers in the system. Second, the system can direct a portion of vapor refrigerant from a low side heat exchanger to a flash tank rather than to a compressor. Third, the system can transfer heat from refrigerant at a compressor suction to refrigerant at the discharge of a high side heat exchanger. By using one or more of these processes, the system improves the efficiency of operation during high ambient temperatures in certain embodiments. Certain embodiments are described below.

According to an embodiment, an apparatus includes a high side heat exchanger, a first ejector, a flash tank, a first low side heat exchanger, a first separator, a second low side heat exchanger, a second separator, an accumulator, a first valve, a second valve, and a compressor. The high side heat exchanger removes heat from a refrigerant. The first ejector receives refrigerant from the high side heat exchanger. The flash tank stores refrigerant. The first ejector directs refrigerant from the high side heat exchanger to the flash tank. The first low side heat exchanger uses refrigerant from the flash tank to cool a first space. The first separator receives refrigerant from the first low side heat exchanger. The refrigerant from the first low side heat exchanger includes a first liquid portion and a first vapor portion. The second low side heat exchanger uses refrigerant from the flash tank to cool a second space. The second separator receives refrigerant from the second low side heat exchanger. The refrigerant from the second low side heat exchanger includes a second liquid portion and a second vapor portion. The accumulator receives the first liquid portion and the second liquid portion. The accumulator separates refrigerant within the accumulator into a third liquid portion and a third vapor portion. The first valve can open to direct the first vapor portion to the first ejector. The first ejector directs the first vapor portion to the flash tank. The first valve can close to direct the first vapor portion to the accumulator. The second valve can open to direct the second vapor portion to the first ejector. The first ejector directs the second vapor portion to the flash tank. The second valve can close to direct the second vapor portion to the accumulator. The compressor compresses the third vapor portion from the accumulator.

According to another embodiment, a method includes removing, by a high side heat exchanger, heat from a refrigerant, receiving, by a first ejector, refrigerant from the high side heat exchanger, and storing, by a flash tank, refrigerant. The method also includes directing, by the first ejector, refrigerant from the high side heat exchanger to the flash tank, using, by a first low side heat exchanger, refrigerant from the flash tank to cool a first space, and receiving, by a first separator, refrigerant from the first low side heat exchanger. The refrigerant from the first low side heat exchanger includes a first liquid portion and a first vapor portion. The method further includes using, by a second low side heat exchanger, refrigerant from the flash tank to cool a second space, and receiving, by a second separator, refrigerant from the second low side heat exchanger. The refrigerant from the second low side heat exchanger includes a second liquid portion and a second vapor portion. The method also includes receiving, by an accumulator, the first liquid portion and the second liquid portion and during a first mode of operation, opening a first valve to direct the first vapor portion to the first ejector, directing, by the first ejector, the first vapor portion to the flash tank, and closing a second valve to direct the second vapor portion to the accumulator. The method further includes, during a second mode of operation, closing the first valve further to direct the first vapor portion to the accumulator, opening the second valve to direct the second vapor portion to the first ejector, and directing, by the first ejector, the second vapor portion to the flash tank. The method further includes separating, by the accumulator, refrigerant within the accumulator into a third liquid portion and a third vapor portion and compressing, by a compressor, the third vapor portion from the accumulator.

According to another embodiment, a system includes a high side heat exchanger, a first ejector, a flash tank, a first low side heat exchanger, a first separator, a second low side heat exchanger, a second separator, an accumulator, a first valve, a second valve, and a compressor. The high side heat exchanger removes heat from a refrigerant. The first ejector receives refrigerant from the high side heat exchanger. The flash tank stores refrigerant. The first ejector directs refrigerant from the high side heat exchanger to the flash tank. The first low side heat exchanger uses refrigerant from the flash tank to cool a first space. The first separator receives refrigerant from the first low side heat exchanger. The refrigerant from the first low side heat exchanger includes a first liquid portion and a first vapor portion. The second low side heat exchanger uses refrigerant from the flash tank to cool a second space. The second separator receives refrigerant from the second low side heat exchanger. The refrigerant from the second low side heat exchanger includes a second liquid portion and a second vapor portion. The accumulator receives the first liquid portion and the second liquid portion and separates refrigerant within the accumulator into a third liquid portion and a third vapor portion. During a first mode of operation, the first valve opens to direct the first vapor portion to the first ejector, the first ejector further directs the first vapor portion to the flash tank, and the second valve closes to direct the second vapor portion to the accumulator. During a second mode of operation, the first valve further closes to direct the first vapor portion to the accumulator, the second valve further opens to direct the second vapor portion to the first ejector, and the first ejector further directs the second vapor portion to the flash tank. The compressor compresses the third vapor portion from the accumulator.

Certain embodiments provide one or more technical advantages. For example, an embodiment improves the efficiency of a carbon dioxide cooling system during high ambient temperatures. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
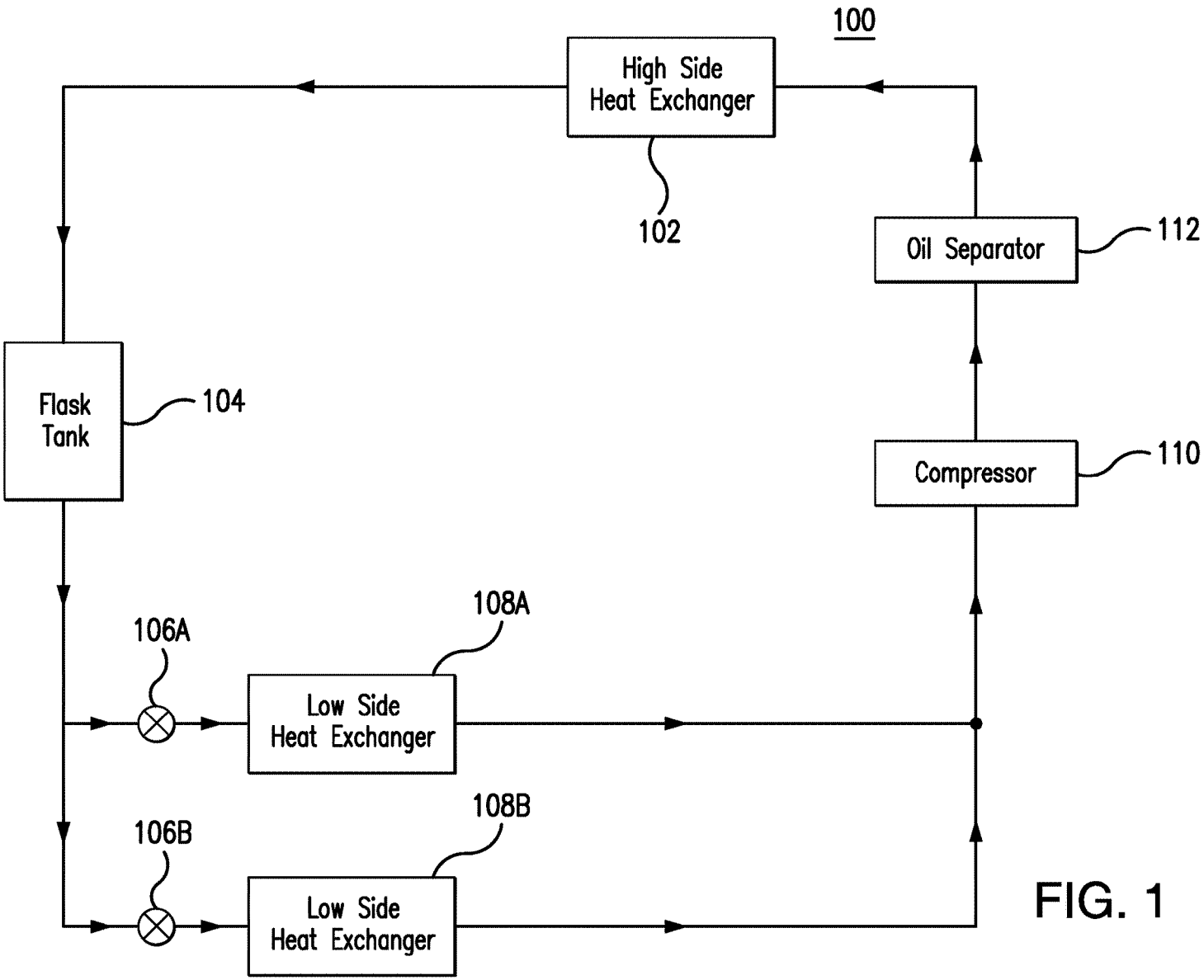
FIG. 1 illustrates an example cooling system.
Figure 2:
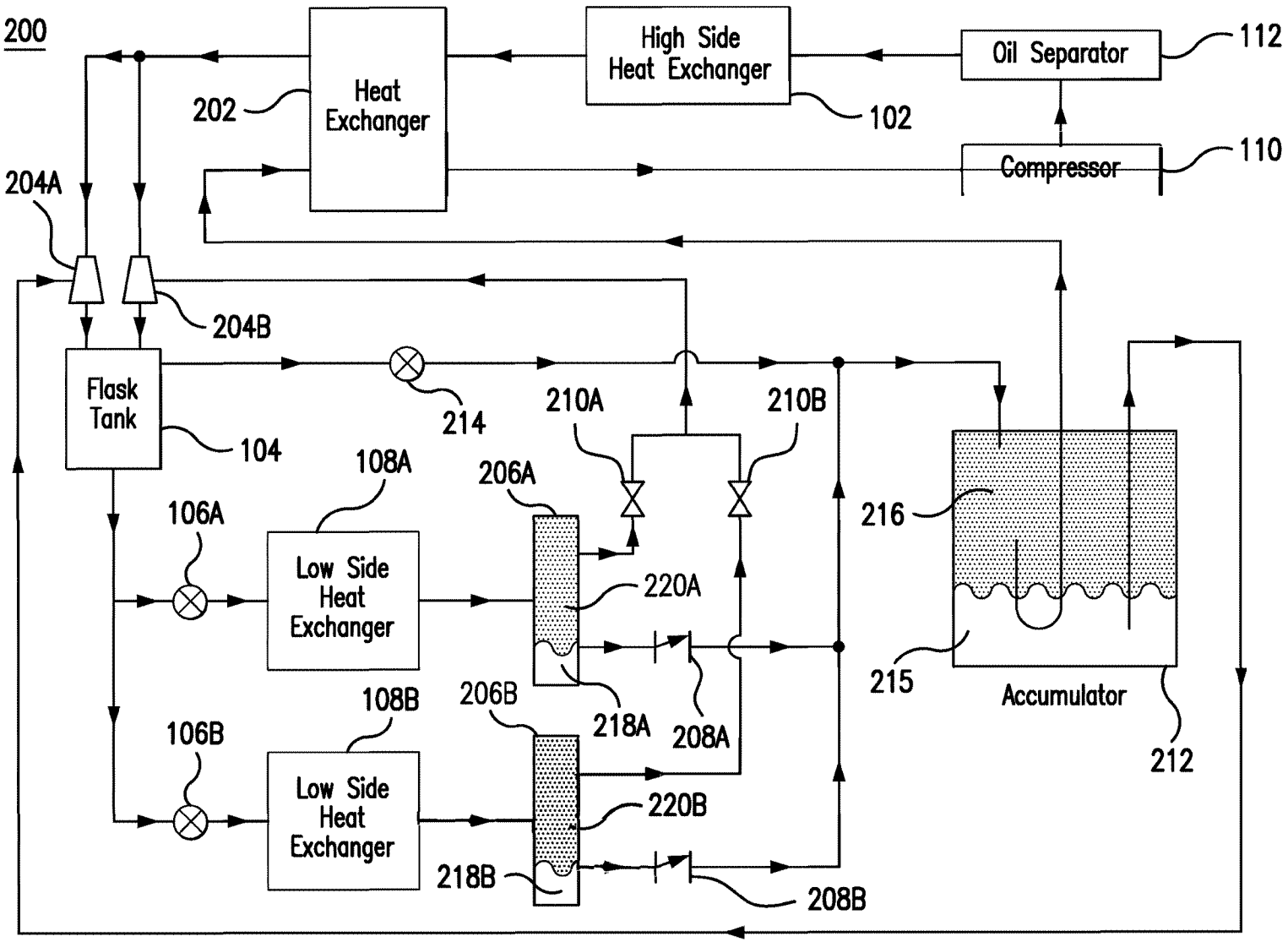
FIG. 2 illustrates an example cooling system.
Figure 3:
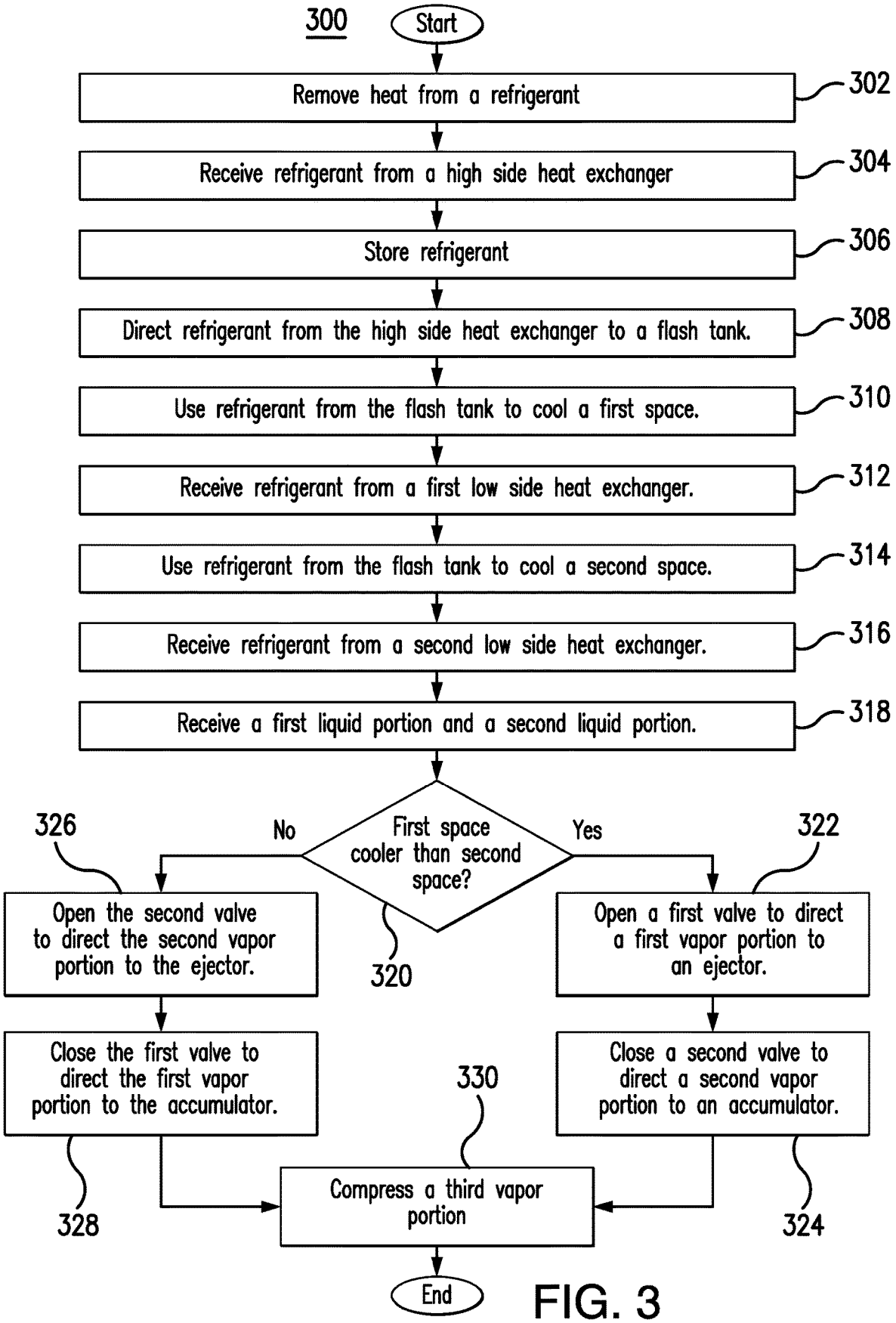
FIG. 3 is a flowchart illustrating a method of operating an example cooling system.

Embodiments of the present disclosure and its advantages are best understood by referring to FIGS. 1 through 3 of the drawings, like numerals being used for like and corresponding parts of the various drawings.

Cooling systems (e.g., refrigeration systems and/or air conditioning systems) may cycle a refrigerant to cool various spaces. For example, a system may cycle refrigerant to cool spaces near or around low side heat exchangers. One refrigerant that has seen increasing use in cooling systems is carbon dioxide, due to its environmentally friendly properties relative to other conventional refrigerants. One drawback of carbon dioxide refrigerant, however, is that carbon dioxide refrigerant is difficult to use and manage in extreme temperatures. For example, cooling systems that use carbon dioxide refrigerant tend to operate more inefficiently in high ambient heat than cooling systems that use other refrigerants. It may be more difficult to regulate the pressure of the carbon dioxide refrigerant and to remove heat from the carbon dioxide refrigerant in high ambient heat.

This disclosure contemplates a cooling system that implements various processes to improve efficiency in high ambient temperatures. First, the system can flood one or more low side heat exchangers in the system. Second, the system can direct a portion of vapor refrigerant from a low side heat exchanger to a flash tank rather than to a compressor. Third, the system can transfer heat from refrigerant at a compressor suction to refrigerant at the discharge of a high side heat exchanger. By using one or more of these processes, the system improves the efficiency of operation during high ambient temperatures in certain embodiments. The cooling system will be described using FIGS. 1 through 3.

FIG. 1 illustrates an example cooling system 100. As shown in FIG. 1, system 100 includes a high side heat exchanger 102, a flash tank 104, one or more valves 106, one or more low side heat exchangers 108, one or more compressors 110, and an oil separator 112. Generally, system 100 cycles a refrigerant (e.g., carbon dioxide refrigerant) to cool one or more spaces. This disclosure contemplates cooling system 100 or any cooling system described herein including any number of low side heat exchangers. Additionally, the cooling systems described herein may be implemented for any suitable cooling application (e.g., a refrigeration system, an air conditioning system, etc.).

High side heat exchanger 102 removes heat from a refrigerant. When heat is removed from the refrigerant, the refrigerant is cooled. This disclosure contemplates high side heat exchanger 102 being operated as a condenser and/or a gas cooler. When operating as a condenser, high side heat exchanger 102 cools the refrigerant such that the state of the refrigerant changes from a gas to a liquid. When operating as a gas cooler, high side heat exchanger 102 cools gaseous refrigerant and the refrigerant remains a gas. In certain configurations, high side heat exchanger 102 is positioned such that heat removed from the refrigerant may be discharged into the air. For example, high side heat exchanger 102 may be positioned on a rooftop so that heat removed from the refrigerant may be discharged into the air. As another example, high side heat exchanger 102 may be positioned external to a building and/or on the side of a building. This disclosure contemplates any suitable refrigerant (e.g., carbon dioxide) being used in any of the disclosed cooling systems.

Flash tank 104 stores refrigerant received from high side heat exchanger 102. This disclosure contemplates flash tank 104 storing refrigerant in any state such as, for example, a liquid state and/or a gaseous state. Refrigerant leaving flash tank 104 is fed to low side heat exchangers 108. In some embodiments, a flash gas and/or a gaseous refrigerant is released from flash tank 104. By releasing flash gas, the pressure within flash tank 104 may be reduced.

One or more valves 106 control a flow of refrigerant from flash tank 104 to one or more low side heat exchangers 108. For example, when valve 106 is opened, refrigerant flows through valve 106. When valve 106 is closed, refrigerant stops flowing through valve 106. In certain embodiments, valve 106 can be opened to varying degrees to adjust the amount of flow of refrigerant. For example, valve 106 may be opened more to increase the flow of refrigerant. As another example, valve 106 may be opened less to decrease the flow of refrigerant.

In certain embodiments, valves 106 are expansion valves that cool the refrigerant flowing through the expansion valves. Valves 106 may receive refrigerant from any component of system 100 such as for example high side heat exchanger 102 and/or flash tank 104. Valves 106 reduce the pressure and therefore the temperature of the refrigerant. Valves 106 reduce pressure from the refrigerant flowing into the valve 106. The temperature of the refrigerant may then drop as pressure is reduced. As a result, refrigerant entering valves 106 may be cooler when leaving valves 106.

Low side heat exchangers 108 use refrigerant from flash tank 104 and/or valves 106 to cool spaces proximate low side heat exchangers 108. For example, if system 100 were a refrigeration system, system 100 may include a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 104 to both the low temperature and medium temperature portions of the refrigeration system. For example, the refrigerant flows to low side heat exchangers 108 that are set to cool spaces to different temperatures. When the refrigerant reaches low side heat exchangers 108, the refrigerant removes heat from the air around low side heat exchangers 108. As a result, the air is cooled. The cooled air may then be circulated such as, for example, by a fan to cool a space such as, for example, a freezer and/or a refrigerated shelf. As refrigerant passes through low side heat exchangers 108, the refrigerant may change from a liquid state to a gaseous state as it absorbs heat. This disclosure contemplates including any number of low side heat exchangers 108 in any of the disclosed cooling systems.

As another example, if system 100 were an air conditioning system, system 100 may include one or more low side heat exchangers 108 that cool different zones of a structure or space to different temperatures. As with the refrigeration system, the refrigerant flowing through low side heat exchangers 108 may absorb heat from the surrounding air to cool the air. This air may then be circulated (e.g., by a fan) to cool a zone or space.

In the example of FIG. 1, system 100 includes valves 106A and 106B and low side heat exchangers 108A and 108B. Valve 106A controls a flow of refrigerant from flash tank 104 to low side heat exchanger 108A. Valve 106B controls a flow of refrigerant from flash tank 104 to low side heat exchanger 108B. System 100 may include any suitable number of valves 106 and low side heat exchangers 108.

Refrigerant flows from low side heat exchangers 108 to one or more compressors 110. This disclosure contemplates the disclosed cooling systems including any number of compressors 110. Compressors 110 compress refrigerant to increase the pressure of the refrigerant. As a result, the heat in the refrigerant may become concentrated and the refrigerant may become a high-pressure gas. The compressors 110 may be arranged in any suitable arrangement (e.g., in series and/or parallel).

Oil separator 112 receives refrigerant from compressor(s) 110. Oil separator 112 separates oil that may have mixed with the refrigerant. The oil may have mixed with the refrigerant in compressor(s) 110. By separating the oil from the refrigerant, oil separator 112 protects other components of system 100 from being clogged and/or damaged by the oil. Oil separator 112 may collect the separated oil. The oil may then be removed from oil separator 112 and added back to compressor(s) 110. Certain embodiments do not include oil separator 112. In these embodiments, refrigerant from compressor(s) 110 flows directly to high side heat exchanger 102.

As discussed previously, system 100 may cycle a carbon dioxide refrigerant to cool spaces. Although carbon dioxide has several environmentally friendly properties, carbon dioxide refrigerant may be difficult to use and manage in extreme temperatures. For example, cooling systems that use carbon dioxide refrigerant tend to operate more inefficiently in high ambient heat than cooling systems that use other refrigerants. It may be more difficult to regulate the pressure of the carbon dioxide refrigerant and to remove heat from the carbon dioxide refrigerant in high ambient heat.

This disclosure contemplates a cooling system that implements various processes to improve efficiency in high ambient temperatures. First, the system can flood one or more low side heat exchangers in the system. Second, the system can direct a portion of vapor refrigerant from a low side heat exchanger to a flash tank rather than to a compressor. Third, the system can transfer heat from refrigerant at a compressor suction to refrigerant at the discharge of a high side heat exchanger. By using one or more of these processes, the system improves the efficiency of operation during high ambient temperatures in certain embodiments. Embodiments of the cooling system are described below using FIGS. 2-3. These figures illustrate embodiments that include a certain number of valves 106, low side heat exchangers 108, and compressors 110 for clarity and readability. However, this disclosure contemplates these embodiments including any suitable number of valves 106, low side heat exchangers 108, and compressors 110.

FIG. 2 illustrates an example cooling system 200. As seen in FIG. 2, system 200 includes a high side heat exchanger 102, a flash tank 104, one or more valves 106, one or more low side heat exchangers 108, one or more compressors 110, an oil separator 112, a heat exchanger 202, one or more ejectors 204, one or more separators 206, one or more valves 208, one or more valves 210, an accumulator 212, and a valve 214. Generally, system 200 implements one or more modifications and/or processes to system 100 that may improve the efficiency of using carbon dioxide refrigerant in high ambient temperatures. These modifications and/or processes may be activated individually or in combination to improve the efficiency of system 200.

Various components of system 200 operate similarly as they did in system 100. For example, high side heat exchanger 102 removes heat from a refrigerant. Flash tank 104 stores a refrigerant. Valves 106 control a flow of refrigerant from flash tank 104 to low side heat exchangers 108. Low side heat exchangers 108 use refrigerant to cool a space proximate low side heat exchangers 108. Compressors 110 compress a refrigerant. Oil separator 112 separates an oil from a refrigerant and directs that refrigerant to high side heat exchanger 102.

The first process implemented by system 200 to improve the efficiency of using carbon dioxide refrigerant in high ambient temperatures is to flood low side heat exchangers 108. In certain embodiments, valves 106 may be opened such that the flow of refrigerant from flash tank 104 to low side heat exchangers 108 is greater than the amount of refrigerant that low side heat exchangers 108 can evaporate. As a result, the discharge from low side heat exchangers 108 includes both a vapor portion and a liquid portion. This disclosure contemplates any suitable number of low side heat exchangers 108 in system 200 operating in the flooded condition. For example, some low side heat exchangers 108 may be operating in a flooded condition while other low side heat exchangers 108 are not operating in the flooded condition. In certain embodiments, by flooding one or more low side heat exchangers 108, an efficiency gain of over 8% can be achieved.

Separators 206 receive the discharge from low side heat exchangers 108. In the example of FIG. 2, separator 206A receives the discharge from low side heat exchangers 108A and separator 206B receives the discharge from low side heat exchangers 108B. As discussed previously, when low side heat exchangers 108 are operating in the flooded condition, the discharge from low side heat exchangers 108 includes both a vapor portion and a liquid portion. Separators 206 separate the liquid portion from the vapor portion. Specifically, the liquid portion sinks to the bottom of separator 206 while the vapor portion rises to the top of separator 206. In the example of FIG. 2, separator 206A receives a liquid portion 218A and a vapor portion 220A from low side heat exchanger 108A, and separator 206B receives a liquid portion 218B and a vapor portion 220B from low side heat exchanger 108B. Separators 206 may direct the liquid portion 218 and the vapor portion 220 to different sections of system 200 in certain embodiments.

Valves 208 and valves 210 control a flow of refrigerant from separators 206. Valves 208 may be check valves that control a flow of refrigerant from separators 206 to accumulator 212. Check valves may not open to direct refrigerant from separators 206 to accumulator 212 until a pressure of that refrigerant exceeds an internal threshold of the check valve. Valves 210 may be solenoid valves that control a flow of vapor portions 220 from separators 206 to ejector 204B. In the example of FIG. 2, valve 208A controls a flow of refrigerant from separators 206A to accumulator 212 and valve 208B controls a flow of refrigerant from separator 206B to accumulator 212. Additionally, valve 210A controls a flow of vapor portion 220A from separator 206A to ejector 204B and valve 210B controls a flow of vapor portion 220B from separator 206B to ejector 204B.

Accumulator 212 receives refrigerant from separators 206. Accumulator 212 separates the refrigerant into a liquid portion 215 and a vapor portion 216. Generally, liquid portion 215 collects at the bottom of accumulator 212 and vapor portion 216 rises to the top of accumulator 212. By separating liquid portion 215 from vapor portion 216, accumulator 212 is able to prevent liquid portion 215 from reaching certain components of system 200, such as, for example, compressor 110. As seen in FIG. 2, accumulator 212 includes a U-shaped pipe that has an entry point above the level of liquid portion 215. As a result, vapor portion 216 is able to enter the U-shaped pipe and be discharged towards compressor 110. On the other hand, liquid portion 215 is not able to enter the U-shaped pipe unless the level of liquid portion 215 rises above the entry of the U-shaped pipe.

In certain embodiments, accumulator 212 includes an additional pipe with an entry positioned in liquid portion 215. The entry of this pipe is below the entry of the U-shaped pipe. The pipe directs the liquid portion 215 to an ejector 204A. Ejector 204A then directs the liquid portion 215 to flash tank 104. In this manner, the level of liquid portion 215 may be controlled such that the level of liquid portion 215 does not rise above the entry of the U-shaped pipe.

In certain embodiments, accumulator 212 receives a flash gas from flash tank 104. Valve 214 may be opened to direct a flash gas from flash tank 104 to accumulator 212. In this manner, the internal pressure of flash tank 104 may be reduced. The flash gas mixes with vapor portion 216 and is discharged by accumulator 212 towards compressor 110.

The second process implemented by system 200 to improve the efficiency of using carbon dioxide refrigerant in high ambient temperatures is to direct vapor portions 220 to an ejector 204B. In certain embodiments, different low side heat exchangers 108 may cool respective spaces to different temperatures. System 200 may direct the vapor portion 220 associated with the low side heat exchanger 108 that is cooling a space to the colder or coldest temperature to ejector 204B while directing the vapor portions 220 of the other low side heat exchangers 108 to accumulator 212. Using the example of FIG. 2, if low side heat exchanger 108A is cooling a space to a colder temperature than low side heat exchanger 108B, then valve 210A may be opened and valve 210B may be closed. As a result, vapor portion 220A is directed through valve 210A to ejector 204B (while liquid portion 218A is directed through valve 208A to accumulator 212). Ejector 204B then directs vapor portion 220A to flash tank 104. Additionally, because valve 210B is closed, vapor portion 220B is directed from separator 206B to accumulator 212 (along with liquid portion 218B). If an operator of system 200 subsequently changes the temperature settings of low side heat exchanger 108A or 108B such that low side heat exchanger 108B is cooling a space to a colder temperature than low side heat exchanger 108A, then valve 210B may be opened and valve 210A may be closed. As a result, vapor portion 220B from separator 206B is directed through valve 210B to ejector 204B (while liquid portion 218B is directed through valve 208B to accumulator 212). Ejector 204B then directs vapor portion 220B to flash tank 104. Additionally, vapor portion 220A from separator 206A is directed to accumulator 212 through valve 208A (along with liquid portion 218A). In embodiments that include more than two low side heat exchangers 108, system 200 may direct the vapor portion 220 of the low side heat exchanger 108 operating at the lowest temperature to ejector 204B. By closing and opening various valves 210, system 200 allows for low side heat exchangers 108 to be adjusted on the fly while maintaining efficiency gains. For example, temperature controls may be adjusted to change the amount of cooling provided by each low side heat exchanger 108. System 200 may open and close certain valves 210 to maintain efficiency gains in response to these adjustments. In particular embodiments, by directing vapor portion 220 to ejector 204B, an efficiency gain of 18% or more may be achieved.

Ejector 204B receives refrigerant from high side heat exchanger 102 and/or separators 206 and directs that refrigerant to flash tank 104. Certain embodiments include an additional ejector 204A that receives refrigerant from high side heat exchanger 102 and accumulator 212 and directs that refrigerant to flash tank 104. In some embodiments, when ejector 204A is active and directing refrigerant to flash tank 104, ejector 204B is inactive. As a result, when ejector 204A is needed (e.g., to lower the level of liquid portion 215 in accumulator 212), ejector 204B shuts off while ejector 204A is activated. When ejector 204A is no longer needed, ejector 204A is shut off and ejector 204B is activated. Generally, ejector 204 ejects and/or directs refrigerant to flash tank 104. In some systems, the pressure of the ejected refrigerant is controlled and/or adjusted by the pressure of the refrigerant entering ejector 204 and the shape of ejector 204.

The third process implemented by system 200 to improve the efficiency of using carbon dioxide refrigerant in high ambient temperatures is to subcool the refrigerant from accumulator 212 using heat exchanger 202. As seen in FIG. 2, heat exchanger 202 receives refrigerant from high side heat exchanger 102 and accumulator 212. When activated, heat exchanger 202 transfers heat from the refrigerant from accumulator 212 to the refrigerant from high side heat exchanger 102. Heat exchanger 202 then discharges the refrigerant from high side heat exchanger 102 to one or more ejectors 204 and flash tank 104. Heat exchanger 202 also directs the refrigerant from accumulator 212 to compressor 110. As a result of this heat transfer, the refrigerant entering compressor 110 is subcooled, which in certain embodiments, results in an efficiency gain of more than 7%.

In summary, system 200 implements three different processes to improve the efficiency of using carbon dioxide refrigerant in high ambient temperatures. First, system 200 may operate one or more low side heat exchangers 108 in a flooded configuration. Second, system 200 may direct vapor portion 220 of certain low side heat exchangers 108 to an ejector 204B. Third, system 200 may use a heat exchanger 202 to subcool refrigerant entering compressor 110. Each of these processes may be activated individually or in combination to achieve varying efficiency gains. In certain instances, none of these processes may be activated in system 200. In certain embodiments, when all three processes are activated, an efficiency gain of 37% or more is achieved. This disclosure contemplates that none, one, two, or three of these processes may be active at one time.

FIG. 3 is a flowchart illustrating a method 300 of operating an example cooling system 200. Generally, various components of system 200 perform the steps of method 300. In particular embodiments, by performing method 300, the efficiency of system 200 is improved.

A high side heat exchanger 102 begins by removing heat from a refrigerant in step 302. In step 304, an ejector 204B receives refrigerant from the high side heat exchanger 102. Flash tank 104 stores refrigerant in step 306. In step 308, the ejector 204B directs refrigerant from the high side heat exchanger 102 to the flash tank 104. Low side heat exchanger 108A uses refrigerant from the flash tank 104 to cool a first space in step 310. In step 312, separator 206A receives refrigerant from low side heat exchanger 108A. Low side heat exchanger 108B uses refrigerant from the flash tank 104 to cool a second space in step 314. In step 316, separator 206B receives refrigerant from low side heat exchanger 108B. As described previously, the refrigerant in separator 206A and 206B includes a liquid portion 218 and a vapor portion 220. In step 318, an accumulator 212 receives a liquid portion 218A from separator 206A and a liquid portion 218B from separator 220B.

In step 320, system 200 determines whether the first space cooled by low side heat exchanger 108A is cooler than the second space cooled by low side heat exchanger 108B. In other words, system 200 determines which low side heat exchanger 108 is operating at the cooler temperature. If low side heat exchanger 108A is operating with a cooler temperature, then in step 322, a valve 210A is opened to direct a vapor portion 220A to ejector 204B. Then, in step 324, a valve 210B is closed to direct vapor portion 220B to accumulator 212. If low side heat exchanger 108B is operating at a cooler temperature than low side heat exchanger 108A, then in step 326, valve 210B is opened to direct vapor portion 220B to ejector 204B. In step 328, valve 210A is closed to direct vapor portion 220A to accumulator 212. In particular embodiments, system 200 may switch between these two different modes of operation depending on the operating temperature of low side heat exchangers 108A and 108B. When the operating temperature of a low side heat exchanger 108 becomes lower than the other low side heat exchanger 108, then system 200 may open and/or close certain valves 210 to direct vapor portions 220 to ejector 204B. In step 330, one or more compressors 110, compress a vapor portion 216 from accumulator 212.

Modifications, additions, or omissions may be made to method 300 depicted in FIG. 3. Method 300 may include more, fewer, or other steps. For example, steps may be performed in parallel or in any suitable order. While discussed as system 200 (or components thereof) performing the steps, any suitable component of system 200 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the high side heat exchanger, the refrigerant from the flash tank, etc.). When such terminology is used, this disclosure is not limiting the described refrigerant to being directly from the particular component. This disclosure contemplates refrigerant being from a particular component (e.g., the high side heat exchanger) even though there may be other intervening components between the particular component and the destination of the refrigerant. For example, the flash tank receives a refrigerant from the accumulator even though there is an ejector between the flash tank and the accumulator.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a high side heat exchanger configured to remove heat from a refrigerant;

a first ejector configured to receive refrigerant from the high side heat exchanger;

a flash tank configured to store refrigerant, the first ejector further configured to direct refrigerant from the high side heat exchanger to the flash tank;

a first low side heat exchanger configured to use refrigerant from the flash tank to cool a first space;

a first separator configured to receive refrigerant from the first low side heat exchanger, the refrigerant from the first low side heat exchanger comprising a first liquid portion and a first vapor portion;

a second low side heat exchanger configured to use refrigerant from the flash tank to cool a second space;

a second separator configured to receive refrigerant from the second low side heat exchanger, the refrigerant from the second low side heat exchanger comprising a second liquid portion and a second vapor portion;

an accumulator configured to receive the first liquid portion and the second liquid portion, the accumulator further configured to separate refrigerant within the accumulator into a third liquid portion and a third vapor portion;

a first valve configured to open to direct the first vapor portion to the first ejector, the first ejector further configured to direct the first vapor portion to the flash tank, the first valve further configured to close to direct the first vapor portion to the accumulator;

a second valve configured to open to direct the second vapor portion to the first ejector, the first ejector further configured to direct the second vapor portion to the flash tank, the second valve further configured to close to direct the second vapor portion to the accumulator; and a compressor configured to compress the third vapor portion from the accumulator.

2. The apparatus of claim 1, further comprising a second ejector configured to direct refrigerant from the high side heat exchanger and the third vapor portion to the flash tank.

3. The apparatus of claim 1, wherein:

the first low side heat exchanger is configured to cool the first space to a first temperature; and the second low side heat exchanger is configured to cool the second space to a second temperature, the second temperature lower than the first temperature, the first valve configured to open when the second temperature is lower than the first temperature, the second valve configured to close when the second temperature is lower than the first temperature.

4. The apparatus of claim 1, further comprising a heat exchanger configured to transfer heat from the third vapor portion to the refrigerant from the high side heat exchanger.

5. The apparatus of claim 1, the accumulator further configured to receive a flash gas from the flash tank.

6. The apparatus of claim 1, further comprising a check valve configured to direct the first liquid portion to the accumulator.

7. The apparatus of claim 1, further comprising an oil separator configured to separate an oil from the refrigerant from the compressor.

8. A method comprising:

removing, by a high side heat exchanger, heat from a refrigerant;

receiving, by a first ejector, refrigerant from the high side heat exchanger;

storing, by a flash tank, refrigerant;

directing, by the first ejector, refrigerant from the high side heat exchanger to the flash tank;

using, by a first low side heat exchanger, refrigerant from the flash tank to cool a first space;

receiving, by a first separator, refrigerant from the first low side heat exchanger, the refrigerant from the first low side heat exchanger comprising a first liquid portion and a first vapor portion;

using, by a second low side heat exchanger, refrigerant from the flash tank to cool a second space;

receiving, by a second separator, refrigerant from the second low side heat exchanger, the refrigerant from the second low side heat exchanger comprising a second liquid portion and a second vapor portion;

receiving, by an accumulator, the first liquid portion and the second liquid portion;

during a first mode of operation:

opening a first valve to direct the first vapor portion to the first ejector;

directing, by the first ejector, the first vapor portion to the flash tank; and closing a second valve to direct the second vapor portion to the accumulator;

during a second mode of operation:

closing the first valve further to direct the first vapor portion to the accumulator;

opening the second valve to direct the second vapor portion to the first ejector; and directing, by the first ejector, the second vapor portion to the flash tank;

separating, by the accumulator, refrigerant within the accumulator into a third liquid portion and a third vapor portion; and compressing, by a compressor, the third vapor portion from the accumulator.

9. The method of claim 8, further comprising directing, by a second ejector, refrigerant from the high side heat exchanger and the third vapor portion to the flash tank.

10. The method of claim 8, wherein:

the first space is cooled to a first temperature; and the second space is cooled to a second temperature, the second temperature lower than the first temperature, the first mode of operation occurs when the second temperature is lower than the first temperature.

11. The method of claim 8, further comprising transferring, by a heat exchanger, heat from the third vapor portion to the refrigerant from the high side heat exchanger.

12. The method of claim 8, receiving, by the accumulator, a flash gas from the flash tank.

13. The method of claim 8, further comprising directing, by a check valve, the first liquid portion to the accumulator.

14. The method of claim 8, further comprising separating, by an oil separator, an oil from the refrigerant from the compressor.

15. A system comprising:

a high side heat exchanger configured to remove heat from a refrigerant;

a first ejector configured to receive refrigerant from the high side heat exchanger;

a flash tank configured to store refrigerant, the first ejector further configured to direct refrigerant from the high side heat exchanger to the flash tank;

a first low side heat exchanger configured to use refrigerant from the flash tank to cool a first space;

a first separator configured to receive refrigerant from the first low side heat exchanger, the refrigerant from the first low side heat exchanger comprising a first liquid portion and a first vapor portion;

a second low side heat exchanger configured to use refrigerant from the flash tank to cool a second space;

a second separator configured to receive refrigerant from the second low side heat exchanger, the refrigerant from the second low side heat exchanger comprising a second liquid portion and a second vapor portion;

an accumulator configured to:

receive the first liquid portion and the second liquid portion; and separate refrigerant within the accumulator into a third liquid portion and a third vapor portion;

a first valve;

a second valve, during a first mode of operation:

the first valve configured to open to direct the first vapor portion to the first ejector;

the first ejector further configured to direct the first vapor portion to the flash tank; and the second valve configured to close to direct the second vapor portion to the accumulator;

during a second mode of operation:

the first valve further configured to close to direct the first vapor portion to the accumulator;

the second valve further configured to open to direct the second vapor portion to the first ejector; and the first ejector further configured to direct the second vapor portion to the flash tank; and a compressor configured to compress the third vapor portion from the accumulator.

16. The system of claim 15, further comprising a second ejector configured to direct refrigerant from the high side heat exchanger and the third vapor portion to the flash tank.

17. The system of claim 15, wherein:

the first low side heat exchanger is configured to cool the first space to a first temperature; and the second low side heat exchanger is configured to cool the second space to a second temperature, the first mode of operation occurring when the first temperature is lower than the second temperature.

18. The system of claim 15, further comprising a heat exchanger configured to transfer heat from the third vapor portion to the refrigerant from the high side heat exchanger.

19. The system of claim 15, the accumulator further configured to receive a flash gas from the flash tank.

20. The system of claim 15, further comprising a check valve configured to direct the first liquid portion to the accumulator.

* * * * *